US010464185B2

(12) United States Patent
Isono et al.

(10) Patent No.: US 10,464,185 B2
(45) Date of Patent: Nov. 5, 2019

(54) SUBSTRATE POLISHING METHOD, TOP RING, AND SUBSTRATE POLISHING APPARATUS

(71) Applicant: EBARA CORPORATION, Tokyo (JP)

(72) Inventors: Shintaro Isono, Tokyo (JP); Hozumi Yasuda, Tokyo (JP); Keisuke Namiki, Tokyo (JP); Osamu Nabeya, Tokyo (JP); Makoto Fukushima, Tokyo (JP); Shingo Togashi, Tokyo (JP); Satoru Yamaki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 294 days.

(21) Appl. No.: 15/458,513

(22) Filed: Mar. 14, 2017

(65) Prior Publication Data

US 2017/0266779 A1 Sep. 21, 2017

(30) Foreign Application Priority Data

Mar. 15, 2016 (JP) ..... 2016-050922
Feb. 8, 2017 (TW) ..... 106104069 A

(51) Int. Cl.
*B24B 37/04* (2012.01)
*B24B 37/32* (2012.01)
*B24B 37/20* (2012.01)

(52) U.S. Cl.
CPC ..... *B24B 37/042* (2013.01); *B24B 37/20* (2013.01); *B24B 37/32* (2013.01)

(58) Field of Classification Search
CPC ..... B24B 37/042; B24B 37/20; B24B 37/32
See application file for complete search history.

(56) References Cited

U.S. PATENT DOCUMENTS 5,527,209 A * 6/1996 Volodarsky ..... B24B 37/0053 451/283
6,890,249 B1 * 5/2005 Zuniga ..... B24B 37/32 451/177
7,740,521 B2 * 6/2010 Hashimoto ..... B24B 37/30 451/289
8,939,817 B2 * 1/2015 Son ..... B24B 41/061 451/288
9,434,044 B2 * 9/2016 Kosuge ..... B24B 37/0053
2002/0098780 A1 * 7/2002 Boo ..... B24B 37/30 451/41
2008/0139087 A1 * 6/2008 Togawa ..... B24B 37/013 451/8
2009/0068935 A1 * 3/2009 Torii ..... B24B 37/345 451/331
2009/0142996 A1 * 6/2009 Yasuda ..... B24B 37/30 451/60

(Continued)

FOREIGN PATENT DOCUMENTS

JP 2009-178800 A 8/2009
JP 5390807 B2 1/2014

*Primary Examiner* — Marc Carlson
(74) *Attorney, Agent, or Firm* — Baker & Hostetler LLP

(57) ABSTRACT

According to one embodiment, a substrate polishing method includes: conveying a substrate to a position above a polishing pad by sucking the substrate by a first region of an elastic film; polishing the substrate while bringing the substrate into contact with the polishing pad; and lifting off the substrate by sucking the substrate by a second region of the elastic film, the second region being larger than the first region.

8 Claims, 14 Drawing Sheets

(56) References Cited

U.S. PATENT DOCUMENTS

| | | | | |
|---|---|---|---|---|
| 2009/0191791 | A1* | 7/2009 | Fukushima | B24B 37/345<br>451/9 |
| 2010/0330878 | A1* | 12/2010 | Kobayashi | B24B 37/005<br>451/5 |
| 2011/0159783 | A1* | 6/2011 | Fukushima | B24B 37/042<br>451/11 |
| 2013/0196573 | A1* | 8/2013 | Fukushima | B24B 37/32<br>451/36 |
| 2016/0176011 | A1* | 6/2016 | Fukushima | B24B 37/042<br>451/288 |

* cited by examiner

SUBSTRATE POLISHING METHOD, TOP RING, AND SUBSTRATE POLISHING APPARATUS

CROSS-REFERENCE TO RELATED APPLICATIONS

This application claims the benefit of Japanese Priority Patent Application JP 2016-050922 filed on Mar. 15, 2016, and Taiwanese Priority Patent Application TW106104069 filed on Feb. 8, 2017, the entire contents of which are incorporated herein by reference.

FIELD

The present techniques relates to a substrate polishing method for polishing a substrate, a top ring for retaining the substrate, and a substrate polishing apparatus having such a top ring.

BACKGROUND AND SUMMARY

A general substrate polishing apparatus polishes the substrate by a following procedure by using a top ring which retains a substrate. First, the top ring receives a substrate from a conveyance apparatus and conveys this to a position above a polishing pad. Then, the top ring retaining substrate is lowered, and the substrate contacts the polishing pad. In this state, the top ring rotates the substrate, and the substrate is polished while polishing liquid is supplied. After the polishing is finished, an operation called lift-off in which the substrate is separated from a polishing surface of the polishing pad and lifted up by lifting up the top ring is carried out (for example, JP 5390807 B2, JP 2009-178800 A). Note that the top ring retains or lifts off the substrate by subjecting the substrate to vacuum suction to a membrane provided at a lower surface of the top ring.

In JP 5390807 B2, vacuum suction is carried out by equivalent degrees both in a case in which the substrate is to be conveyed to a position above the polishing pad and in a case in which the substrate is to be lifted off. However, if the vacuum suction force is excessively strong, stress may be applied to the substrate and may damage the substrate when the substrate is to be conveyed to a position above the polishing pad. Reversely, if the vacuum suction force is too weak, the substrate may be cracked or missed when the substrate is to be lifted off. This is because the polishing liquid is present between the substrate and the polishing pad, and surface tension may be caused between the polished substrate and the polishing pad.

On the other hand, JP 2009-178800 A discloses increasing the vacuum degree in lift-off compared with the case in which the substrate is conveyed to a position above the polishing pad. However, since the vacuum degree of the entire membrane is not increased, lift-off is not always reliably carried out.

Therefore, a substrate polishing method and a substrate polishing apparatus capable of appropriately handling substrates and a top ring for such a substrate polishing apparatus are desired.

According to one embodiment, a substrate polishing method includes: conveying a substrate to a position above a polishing pad by sucking the substrate by a first region of an elastic film; polishing the substrate while bringing the substrate into contact with the polishing pad; and lifting off the substrate by sucking the substrate by a second region of the elastic film, the second region being larger than the first region.

According to another embodiment, a substrate polishing method includes: conveying a substrate to a position above a polishing pad by depressurizing a first area among pressure adjustable areas between a top-ring main body and an elastic film to suck the substrate by a lower surface of the elastic film; polishing the substrate while bringing the substrate into contact with the polishing pad; and lifting off the substrate by depressurizing a second area among the pressure adjustable areas to suck the substrate by the lower surface of the elastic film, the second area being larger than the first area.

According to another embodiment, a top ring configured to retain a substrate includes: a top-ring main body; an elastic film below the top-ring main body and configured to form one or a plurality of pressure adjustable areas between the top-ring main body and the elastic film; and a supporter in the area extending toward the elastic film.

According to another embodiment, a substrate polishing apparatus includes: the mentioned top ring; a polishing table having a polishing pad configured to contact the substrate retained by the top ring to polish the substrate; and a pressure controller configured to control a pressure of the pressure adjustable areas.

DETAILED DESCRIPTION OF NON-LIMITING EXAMPLE EMBODIMENTS

Figure 1:
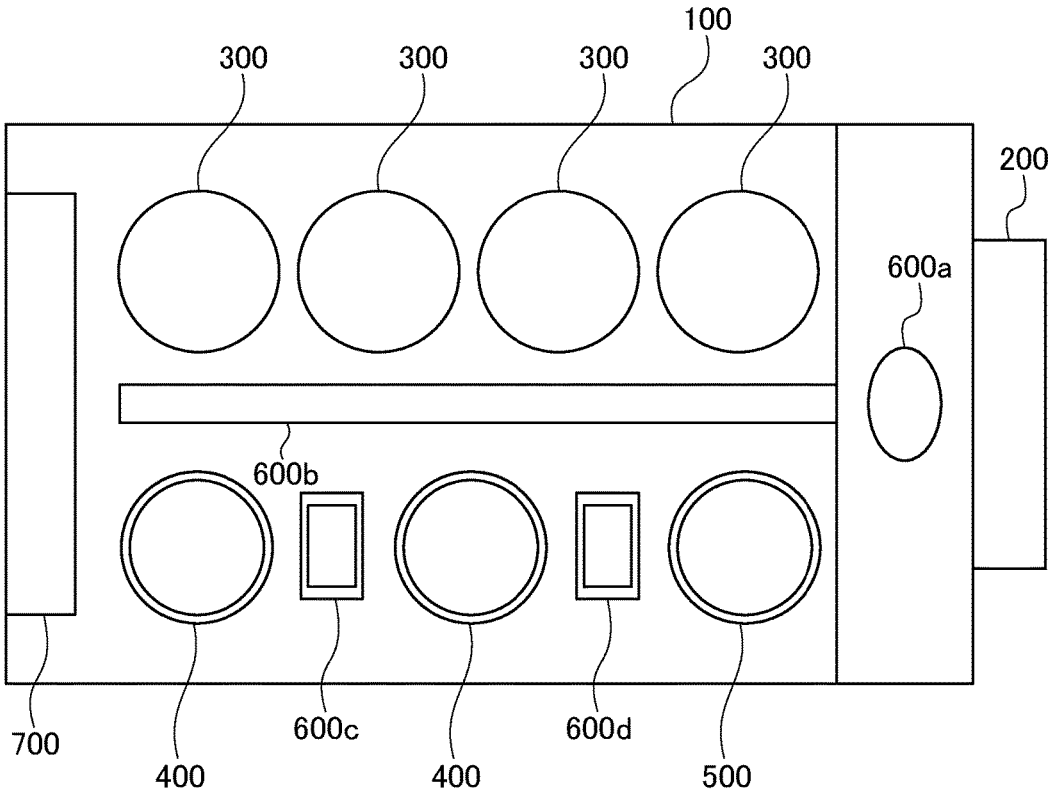
FIG. 1 is a brief top view of a substrate treatment apparatus.

Hereinafter, substrate drying apparatuses of embodiments will be described. Note that the embodiments described below show examples of the cases to carry out the present techniques, and the present techniques are not limited to the specific configurations described below. To carry out the present techniques, specific configurations corresponding to the embodiments may be appropriately employed.

According to one embodiment, a substrate polishing method includes: conveying a substrate to a position above a polishing pad by sucking the substrate by a first region of an elastic film; polishing the substrate while bringing the substrate into contact with the polishing pad; and lifting off the substrate by sucking the substrate by a second region of the elastic film, the second region being larger than the first region.

Since the substrate is sucked by the narrow region when the substrate is to be conveyed to the polishing pad, the stress applied to the substrate can be reduced. Moreover, since the substrate is sucked by the large region when the substrate is to be lifted off, the substrate can be reliably lifted off According to another embodiment, a substrate polishing method includes: conveying a substrate to a position above a polishing pad by depressurizing a first area among pressure adjustable areas between a top-ring main body and an elastic film to suck the substrate by a lower surface of the elastic film; polishing the substrate while bringing the substrate into contact with the polishing pad; and lifting off the substrate by depressurizing a second area among the pressure adjustable areas to suck the substrate by the lower surface of the elastic film, the second area being larger than the first area.

Since the narrow area is depressurized to suck the substrate when the substrate is to be conveyed to the polishing pad, the stress applied to the substrate can be reduced. Moreover, since the large area is depressurized to suck the substrate when the substrate is to be lifted off, the substrate can be reliably lifted off.

Preferably, the plurality of pressure adjustable areas are formed between the top-ring main body and the elastic film, the first area comprises a first number of areas among the plurality of areas, and the second area comprises a second number of areas among the plurality of areas, the second number being larger than the first number.

By virtue of this, the second area is enabled to be larger than the first area.

Preferably, upon polishing the substrate, at least part of the pressure adjustable areas is pressurized.

In this case, since the area depressurized before polishing is narrow, pressurization to a desired pressure can be quickly carried out in polishing.

Preferably, a supporter extending toward the elastic film is provided in the pressure adjustable area.

Since the supporter is provided, even when suction is carried out by a large area in lift-off, shape changes of the elastic film are reduced, and the stress applied to the substrate can be reduced.

According to one embodiment, a top ring configured to retain a substrate, the top ring includes: a top-ring main body; an elastic film below the top-ring main body and configured to form one or a plurality of pressure adjustable areas between the top-ring main body and the elastic film; and a supporter in the area extending toward the elastic film.

Since the supporter is provided, even when suction is carried out by a large area in lift-off, shape changes of the elastic film are reduced, and the stress applied to the substrate can be reduced.

Preferably, the top ring further includes a retaining member configured to retain the elastic film to the top ring, wherein the supporter is a projection extending from the retaining member.

Since the supporter has a projection shape, stretching of the elastic film is not disturbed.

Preferably, the substrate is sucked by a lower surface of the elastic film, and the supporter is provided at a part corresponding to an edge of the sucked substrate.

Since the supporter is provided at the part corresponding to the edge, particularly deformation of the substrate can be suppressed.

Preferably, the substrate is sucked by a lower surface of the elastic film, and when the substrate is sucked, the supporter suppresses a shape change of the elastic film in a vertical direction.

By virtue of this, the stress applied to the substrate can be reduced.

Preferably, the top ring further includes a retainer ring below the top-ring main body and around the elastic film. Additionally, the retainer ring may includes an inner ring and an outer ring provided outside thereof.

According to another embodiment, a substrate polishing apparatus includes: the above top ring according to claim 8; a polishing pad configured to contact the substrate retained by the top ring to polish the substrate; and a pressure controller configured to control a pressure of the pressure adjustable areas.

Preferably, the pressure controller is configured to depressurizes a first area among the pressure adjustable areas when the substrate is conveyed before the substrate is polished, and depressurizes a second area among the pressure adjustable areas when the substrate is lifted off from the polishing pad after the substrate is polished, second area being larger than the first area.

Since the narrow area is depressurized to suck the substrate in the conveyance before polishing, the stress applied to the substrate can be reduced. Moreover, since the large area is depressurized to suck the substrate when the substrate is to be lifted off, the substrate can be reliably lifted off.

Hereinafter, embodiments according to the present invention will be described in detail with reference to drawings.

(First Embodiment)

FIG. 1 is a brief top view of a substrate treatment apparatus. The present substrate treatment apparatus processes various substrates in manufacturing processes of magnetic films of: semiconductor wafers having a diameter of 300 mm or 450 mm; flat panels; images sensors of CMOS (Complementary Metal Oxide Semiconductor), CCD (Charge Coupled Device), etc.; and MRAM (Magnetoresistive Random Access Memory).

The substrate treatment apparatus is provided with: a housing 100 having an approximately rectangular shape, a load port 200 on which a substrate cassette stocking many substrates is placed, one or a plurality of (four in the aspect shown in FIG. 1) substrate polishing apparatuses 300, one or a plurality of (two in the aspect shown in FIG. 1) substrate cleaning apparatuses 400, a substrate drying apparatus 500, conveyance mechanisms 600*a* to 600*d*, and a controller 700.

The load port 200 is disposed to be adjacent to the housing 100. The load port 200 can be equipped with an open cassette, a SMIF (Standard Mechanical Interface) pod, or a FOUP (Front Opening Unified Pod). The SMIF pod and FOUP are hermetically-closed containers capable of maintaining an environment which is independent from external space by housing a substrate cassette therein and covering it with dividing walls.

The substrate polishing apparatuses 300, which polish substrates; the substrate cleaning apparatuses 400, which clean the polished substrates; and the substrate drying apparatus 500, which dry the cleaned substrates are housed in the housing 100. The substrate polishing apparatuses 300 are arranged along a longitudinal direction of the substrate treatment apparatus, and the substrate cleaning apparatuses 400 and the substrate drying apparatus 500 are also arranged along the longitudinal direction of the substrate treatment apparatus.

In a region surrounded by the load port 200, the substrate polishing apparatus 300 positioned in the load-port-200 side, and the substrate drying apparatus 500, the conveyance mechanism 600*a* is disposed. Moreover, the conveyance mechanism 600*b* is disposed in parallel to the substrate polishing apparatuses 300, the substrate cleaning apparatuses 400, and the substrate drying apparatus 500.

The conveyance mechanism 600*a* receives unpolished substrates from the load port 200 and delivers the substrates to the conveyance mechanism 600*b*, and the conveyance mechanism 600*a* receives the dried substrates, which have been taken out from the substrate drying apparatus 500, from the conveyance mechanism 600*b*.

The conveyance mechanism 600*b* is, for example, a linear transporter and delivers the unpolished substrates, which have been received from the conveyance mechanism 600*a*, to the substrate polishing apparatuses 300. As described later, the substrate polishing apparatuses 300 receive the substrates by vacuum suction. The conveyance mechanism 600*b* receives the polished substrates again and delivers the substrates to the substrate cleaning apparatuses 400.

Furthermore, between the two substrate cleaning apparatuses 400, the conveyance mechanism 600*c*, which carries out delivery of substrates between these substrate cleaning apparatuses 400, is disposed. Moreover, between the substrate cleaning apparatus 400 and the substrate drying apparatus 500, the conveyance mechanism 600*d*, which carries out delivery of substrates between the substrate cleaning apparatus 400 and the substrate drying apparatus 500, is disposed.

The controller 700 controls the movement of each device of the substrate treatment apparatus; and the controller 700 may be disposed in the housing 100, may be disposed outside the housing 100, or may be provided in each of the substrate polishing apparatuses 300, the substrate cleaning apparatuses 400, and the substrate drying apparatus 500.

Figure 2:
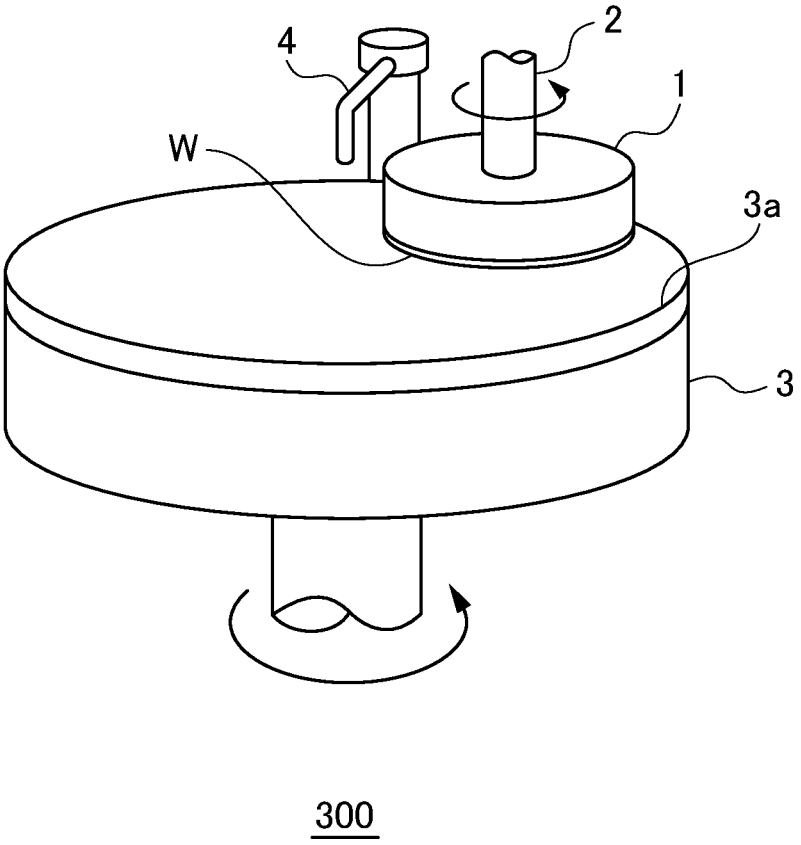
FIG. 2 is a brief perspective view of a substrate polishing apparatus.
Figure 3:
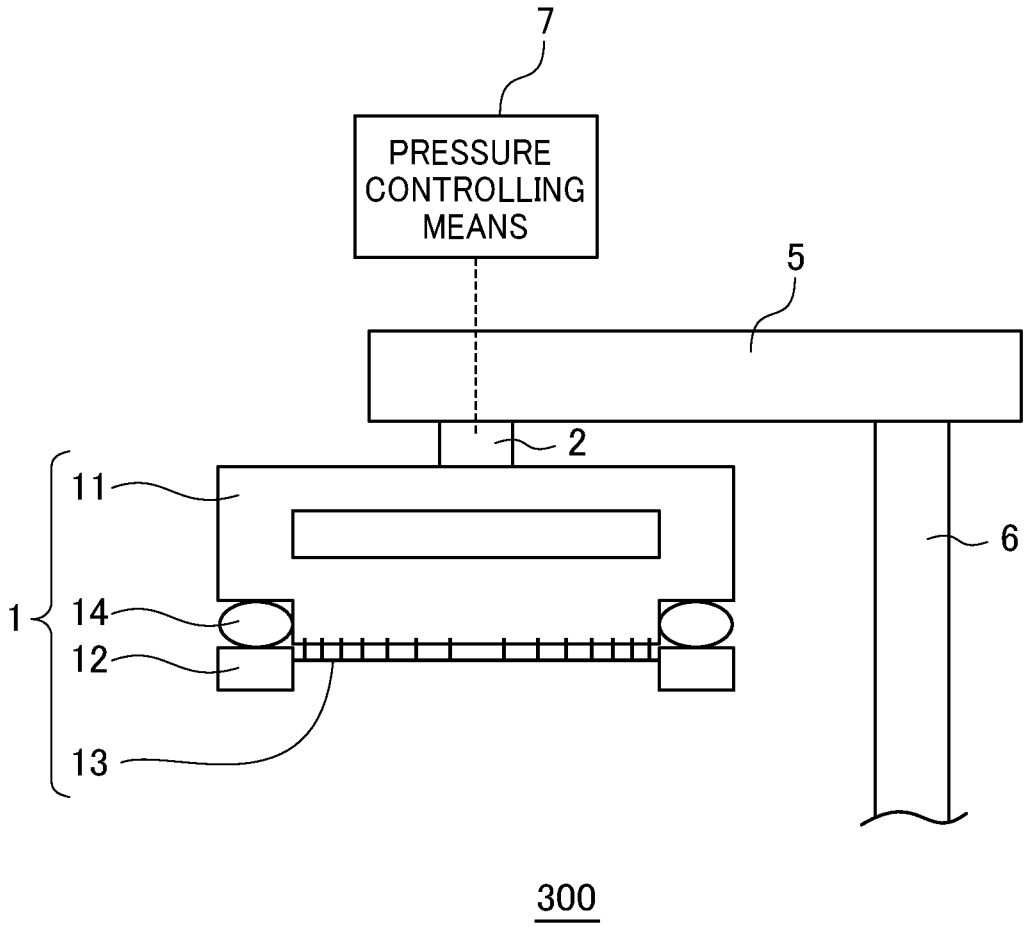
FIG. 3 is a brief cross-sectional view of the substrate polishing apparatus.

FIG. 2 and FIG. 3 are a brief perspective view and a brief cross-sectional view of the substrate polishing apparatus 300, respectively. The substrate polishing apparatus 300 has: a top ring 1, a top-ring shaft 2 having a lower portion to which the top ring 1 is coupled, a polishing table 3 having a polishing pad 3*a*, a nozzle 4 which supplies polishing liquid onto the polishing table 3, a top-ring head 5, a support shaft 6, and a pressure controlling means 7.

The top ring 1 retains a substrate W. As shown in FIG. 3, the top ring 1 includes: a top-ring main body 11, an annular retainer ring 12, a flexible membrane 13 (elastic film) provided below the top-ring main body 11 and inside the retainer ring 12, and an air bag 14 provided between the top-ring main body 11 and the retainer ring 12.

Since the air bag 14 is provided, the retainer ring 12 can be subjected to relative movement in the direction vertical to the top-ring main body 11. Meanwhile, when the pressure controlling means 7 depressurizes the space between the top-ring main body 11 and the membrane 13, an upper surface of the substrate W is retained by the top ring 1 (more specifically, a lower surface of the membrane 13). A peripheral edge of the retained substrate W is surrounded by the retainer ring 12 so that the substrate W is not ejected from the top ring 1 during polishing.

Note that the retainer ring 12 may be a single member or have a double ring configuration including an inner ring and an outer ring provided outside thereof. In the latter case, the outer ring may be fixed to the top-ring main body 11, and the air bag 14 may be provided between the inner ring and the top-ring main body 11.

A lower end of the top-ring shaft 2 is coupled to the center of an upper surface of the top ring 1. When an unshown lifting/lowering mechanism lifts up or lowers the top-ring shaft 2, the lower surface of the substrate W retained by the top ring 1 is brought into contact with or is separated from the polishing pad 3*a*. Meanwhile, when an unshown motor rotates the top-ring shaft 2, the top ring 1 rotates, thereby also rotating the substrate W retained by that.

The polishing pad 3*a* is provided on an upper surface of the polishing table 3. A lower surface of the polishing table 3 is connected to a rotating shaft, and the polishing table 3 is rotatable. The substrate W is polished when the substrate W and the polishing table 3 rotate in a state in which the polishing liquid is supplied from the nozzle 4 and the lower surface of the substrate W is in contact with the polishing pad 3*a*.

The top-ring head 5 has one end coupled to the top-ring shaft 2 and has another end coupled to the support shaft 6. When an unshown motor rotates the support shaft 6, the top-ring head 5 swings, and the top ring 1 is moved back and forth between the position above the polishing pad 3*a* and a substrate delivery position (not shown).

The pressure controlling means 7 adjusts the pressure of the space formed between the top-ring main body 11 and the membrane 13 by supplying a fluid between the top-ring main body 11 and the membrane 13, vacuuming, or opening the space to atmosphere.

Figure 4:
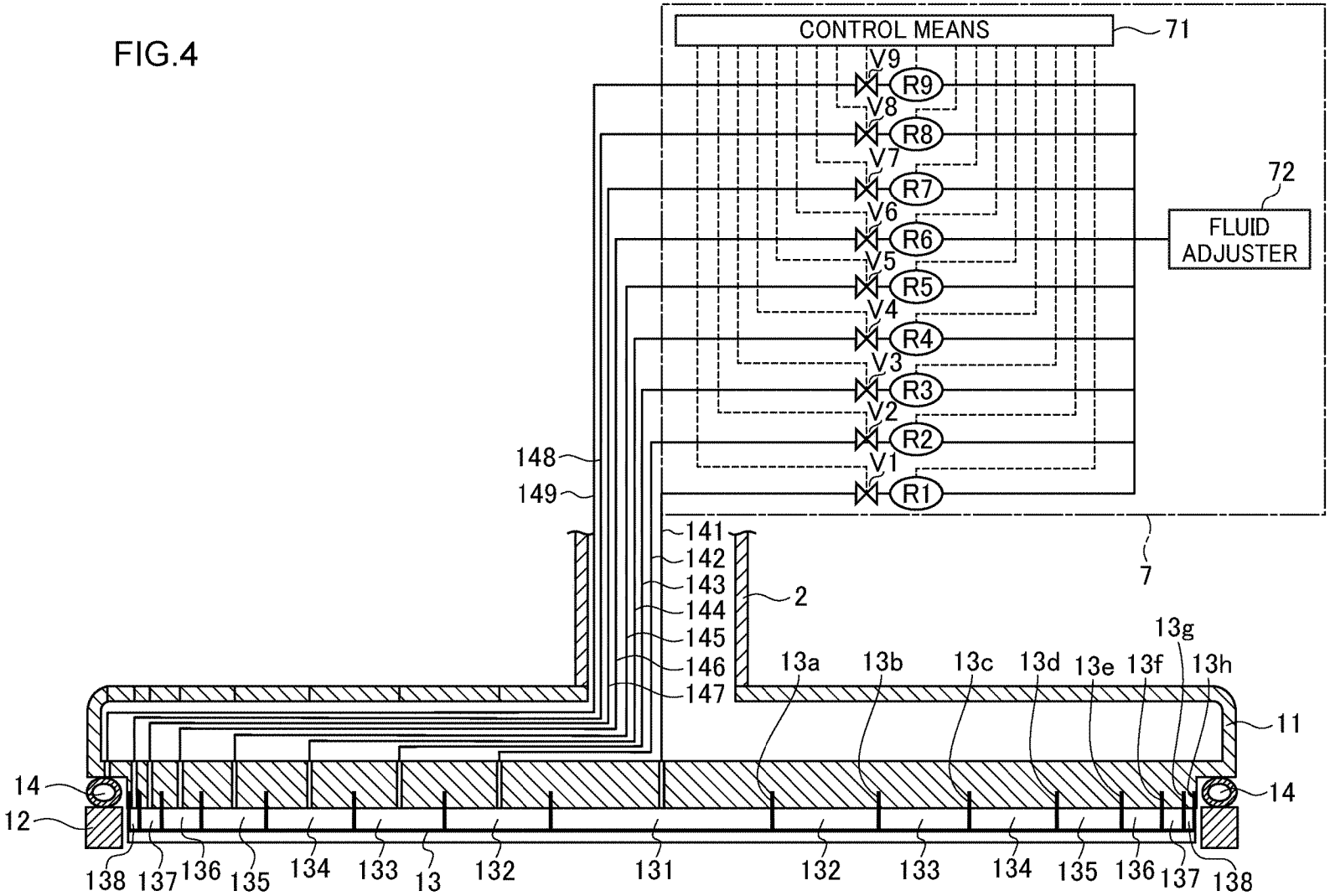
FIG. 4 is a cross-sectional view schematically showing a structure of a top ring.

FIG. 4 is a cross-sectional view schematically showing the structure of the top ring 1. On the membrane 13, peripheral walls 13*a* to 13*h* extending upward toward the top-ring main body 11 are formed. Areas 131 to 138 divided by the peripheral walls 13*a* to 13*h* are formed by these peripheral walls 13*a* to 13*h* between an upper surface of the membrane 13 and a lower surface of the top-ring main body 11. The area 131 is positioned approximately at the center of the top ring 1 and is circular. The area 132 is positioned outside the area 131 and is annular. Thereafter, the areas 133 to 138 are similarly annular.

Flow channels 141 to 148, which penetrate through the top-ring main body 11 and communicate respectively with the areas 131 to 138, are formed. Meanwhile, the air bag 14 including an elastic film is provided immediately above the retainer ring 12, and a flow channel 149, which communicates with the air bag 14, is similarly formed. Pressure sensors and/or flow-rate sensors may be provided on the flow channels 141 to 149.

The flow channels 141 to 149 are connected to the pressure controlling means 7 so that the pressures in the areas 131 to 138 and the air bag 14 can be adjusted. Hereinafter, a configuration example of the pressure controlling means 7 will be described.

The pressure controlling means 7 has: a control apparatus 71, open/close valves V1 to V9 and pressure regulators R1 to R9 controlled by the control apparatus 71, and a fluid adjuster 72. The flow channel 141 is connected to the fluid adjuster 72 via the open/close valve V1 and the pressure regulator R1. The same applies also to the flow channels 142 to 149. The fluid adjuster 72 supplies the fluid and carries out vacuuming.

For example, if the pressure of the area 131 is to be adjusted, the control apparatus 71 opens the valve V1 and adjusts the pressure regulator R1. As a result, the fluid is supplied from the fluid adjuster 72 to the area 131 and the area 131 is pressurized, or the fluid adjuster 72 vacuums the area 131 and the area 131 is depressurized.

Figure 5:
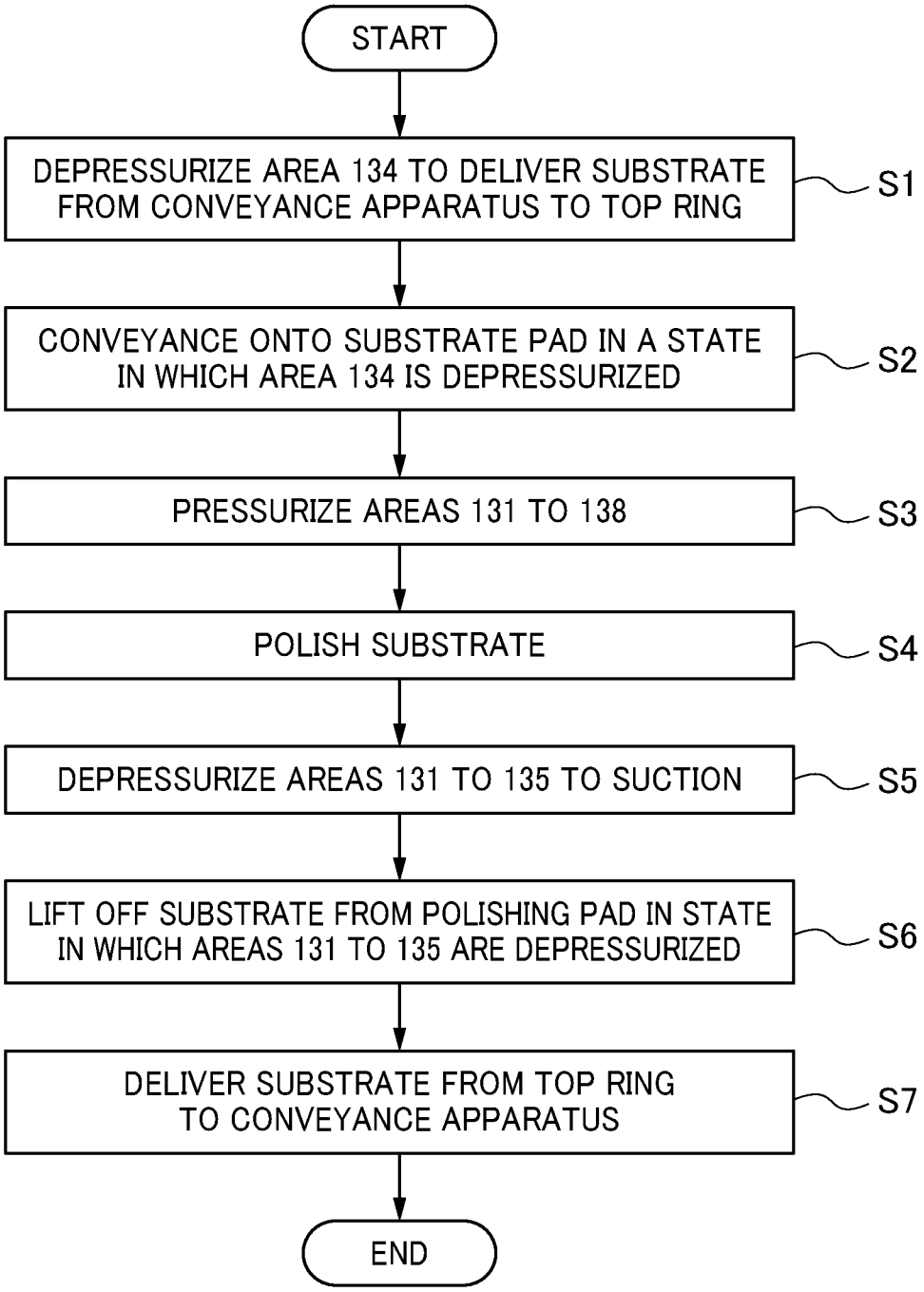
FIG. 5 is a flow chart describing a substrate polishing process by the substrate polishing apparatus.
Figure 6:
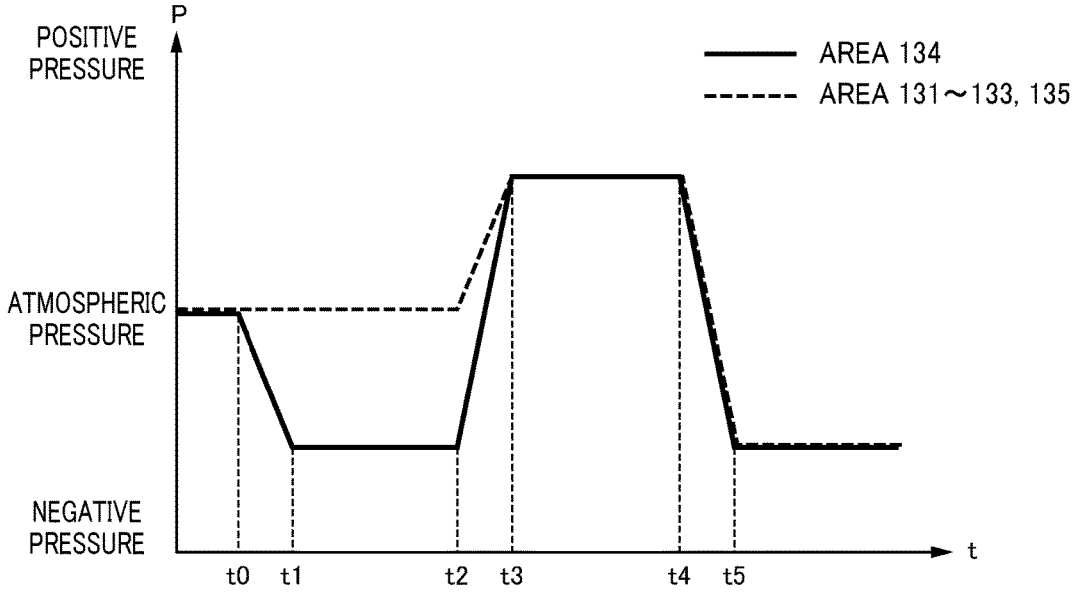
FIG. 6 is a diagram schematically showing pressure changes of areas.

FIG. 5 is a flow chart describing a substrate polishing process by the substrate polishing apparatus 300. Meanwhile, FIG. 6 is a diagram schematically showing pressure changes of the areas 131 to 135, wherein a solid line represents the pressure changes of the area 134, and broken lines represent the pressure changes of the areas 131 to 133 and 135.

First, the top-ring head 5 swings, thereby moving the top ring 1 to the substrate delivery position; and the pressure controlling means 7 depressurizes the area 134, thereby delivering the substrate W from the conveyance mechanism 600*b* to the top ring 1. (Step S1)

Figure 7A:
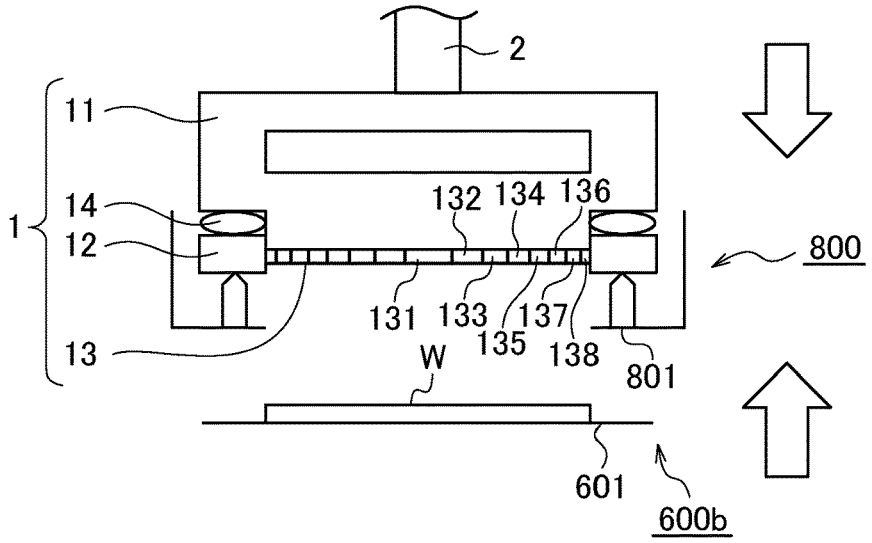
FIGS. 7A to 7C are diagrams describing substrate delivery from a conveyance mechanism to the top ring in detail.
Figure 7B:
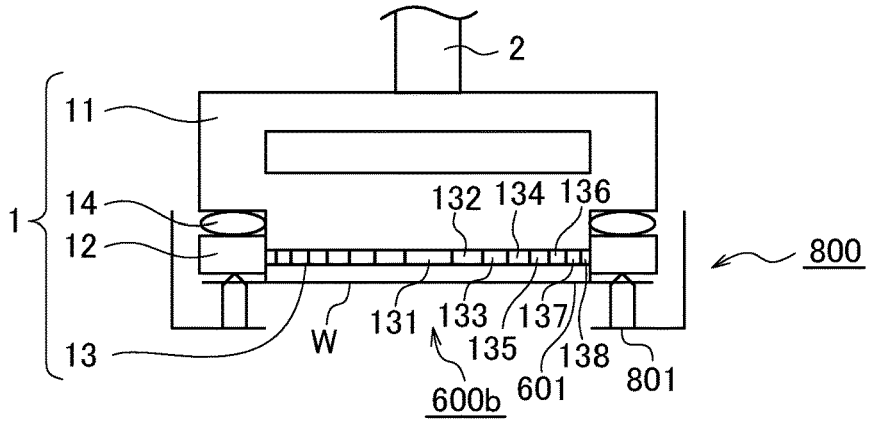
Figure 7C:
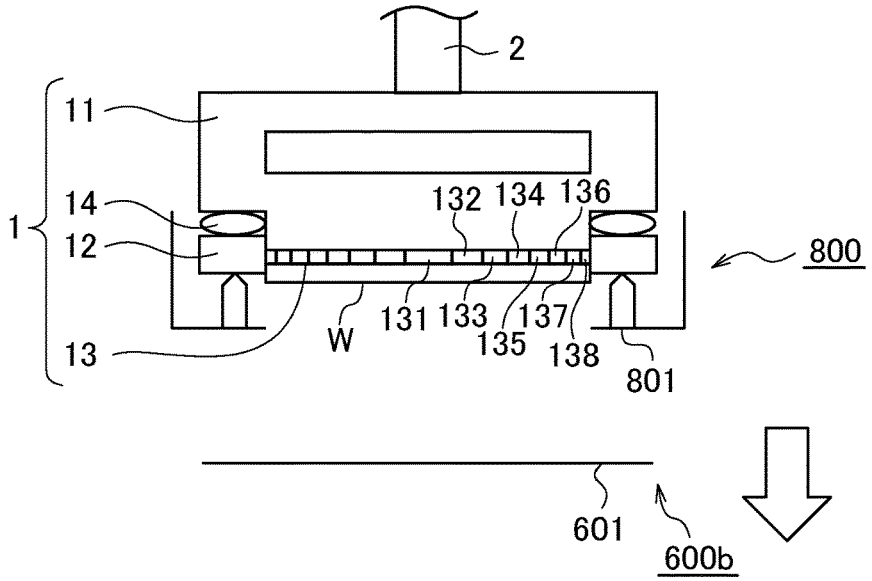
Figure 8:
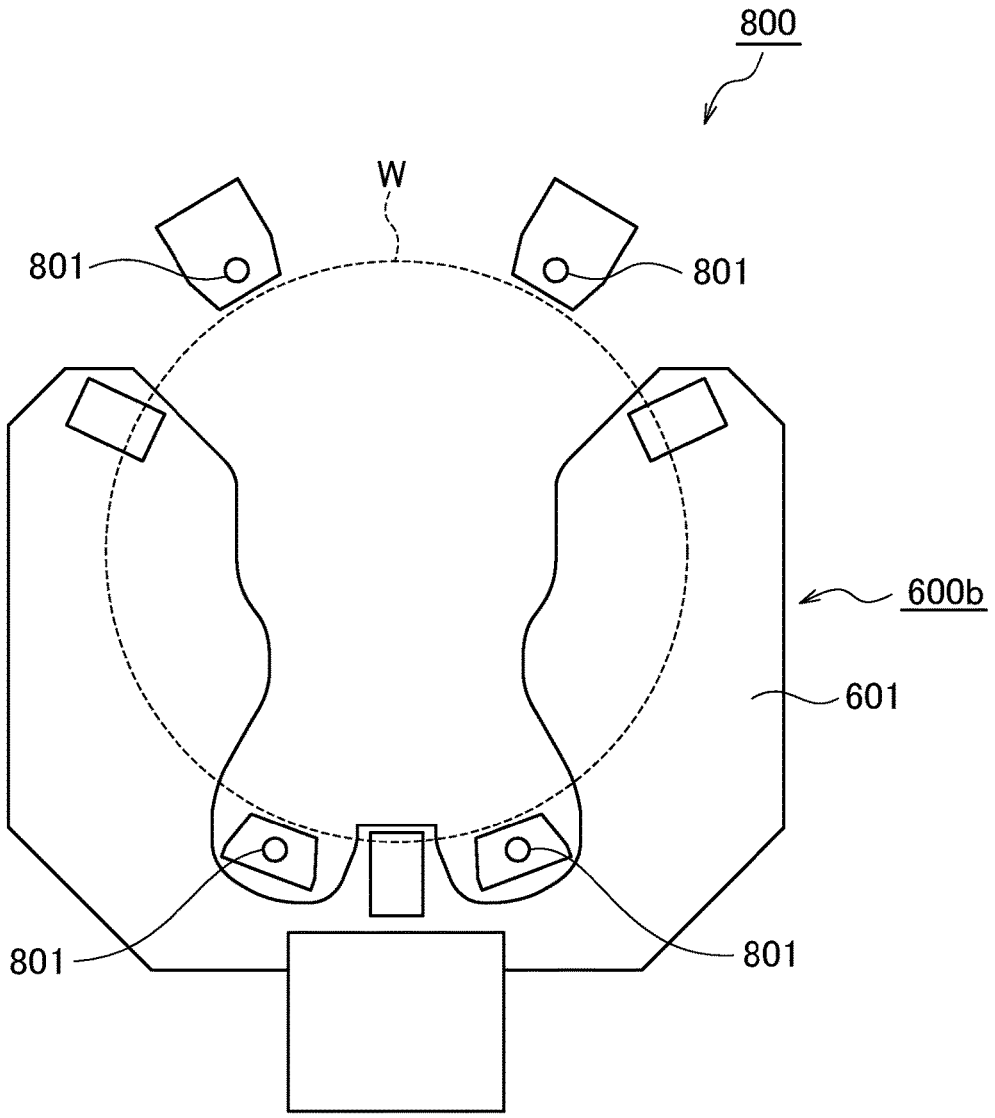
FIG. 8 is a diagram describing the substrate delivery from the conveyance mechanism to the top ring in detail.

FIGS. 7A to 7C and 8 are diagrams describing the substrate delivery from the conveyance mechanism 600*b* to the top ring 1 in detail. FIGS. 7A to 7C are diagram showing the conveyance mechanism 600*b* and the top ring 1 seen from a lateral side, and FIG. 8 is a diagram showing them seen from the upper side.

As shown in FIG. 7A, the substrate W is placed on a hand 601 of the conveyance mechanism 600*b*. Meanwhile, the delivery of the substrate W uses a retainer-ring station 800. The retainer-ring station 800 has push-up pins 801, which push up the retainer ring 12 of the top ring 1.

As shown in FIG. 8, the hand 601 supports part of the outer peripheral side of the lower surface of the substrate W. The push-up pins 801 and the hand 601 are disposed so as not to contact with each other.

In the state shown in FIG. 7A, the top ring 1 is lowered, and the conveyance mechanism 600*b* is lifted up. When the top ring 1 is lowered, the push-up pins 801 push up the retainer ring 12, and the substrate W approaches the membrane 13. When the conveyance mechanism 600*b* is further lifted up, the upper surface of the substrate W contacts the lower surface of the membrane 13 (FIG. 7B).

In this state, the membrane 13 of the top ring 1 sucks the substrate W. Specifically, the pressure controlling means 7 in the present embodiment depressurizes the area 134 among the areas 131 to 138 (for example, −50 kPa, time t0 to t1 of FIG. 6), and, by virtue of this, the substrate W is sucked by the membrane 13. In this process, the pressure controlling means 7 does not depressurize the other areas 131 to 133 and 135 to 138. Therefore, the substrate W is sucked and retained by the narrow region below the area 134 on the lower surface of the membrane 13 (in other words, annular region), but is not sucked by other positions. In other words, the suction range of the substrate W is narrow.

After the substrate W is sucked by the membrane 13 in this manner, the conveyance mechanism 600*b* is lowered (FIG. 7C).

Returning to FIG. 5, when the top-ring head 5 retaining the substrate W swings in the state in which the area 134 is depressurized, the top ring 1 is moved to a position above the polishing pad 3*a*. As a result, the substrate W is conveyed to the upper side of the polishing pad 3*a* (step S2 of FIG. 5, time t1 to t2 of FIG. 6). Since the suction range of the substrate W is narrow, in other words, since the substrate W is sucked by the narrow region of the membrane 13, the stress applied to the substrate W in the conveyance before polishing can be reduced.

Furthermore, when the top-ring shaft 2 is lowered, the lower surface of the substrate W contacts the upper surface of the polishing pad 3*a*. In this state, the pressure controlling means 7 pressurizes the areas 131 to 138 so that the lower surface of the substrate W is pushed against the polishing pad 3*a* (step S3 of FIG. 5, time t2 to t3 of FIG. 6). At this point, since only the area 134 has been depressurized in advance, the time required for the membrane 13 to change from a shape for conveyance before polishing to a shape for polishing is short, and the pressure controlling means 7 can quickly pressurize the areas 131 to 138 to a desired pressure.

Then, when the top ring 1 and the polishing table 3 rotate while the polishing liquid is supplied from the nozzle 4 onto the polishing pad 3*a*, the substrate W is polished (step S4 of FIG. 5, time t3 to t4 of FIG. 6).

When polishing is completed, the substrate W is sucked by the lower surface of the membrane 13 of the top ring 1. Specifically, the pressure controlling means 7 in the present embodiment depressurizes not only the area 134 among the areas 131 to 138, but also depressurizes the areas 131 to 133 and 135 (for example, −50 kPa, step S5 of FIG. 5, time t4 to t5 of FIG. 6), thereby sucking the substrate W by the membrane 13. Therefore, the substrate W is sucked by the large region below the areas 131 to 135 of the membrane 13. In other words, the suction range of the substrate W is large.

In this manner, in conveyance, the top ring 1 sucks the substrate W on the conveyance mechanism 600*b* by the annular (relatively narrow) area 134; on the other hand, after polishing, the substrate W on the polishing pad 3*a* is sucked by the areas 131 to 135, which are concentrically larger. More specifically, in addition to the annular area 134 of the conveyance, the top ring 1 sucks the substrate by the inner areas 131 to 133 and the outer area 135 of the area 134 after polishing.

When the top-ring shaft 2 is lifted up in the state in which the areas 131 to 135 are depressurized, the substrate W is lifted off from the polishing pad 3*a* (step S6 of FIG. 5).

Liquid such as the polishing liquid is present between the substrate W and the polishing pad 3*a*, and suction force is generated between the substrate W and the polishing pad 3*a*. If the force to suck the substrate W by the top ring 1 is weak, the substrate W cannot be lifted off and be missed in some cases. On the other hand, in the present embodiment, since the suction range of the substrate W is large, in other words, since the substrate W is sucked by the large region of the membrane 13, the suction force between the substrate W and the membrane 13 is stronger than the suction force between the substrate W and the polishing pad 3*a*. Therefore, the top ring 1 can reliably lift off the substrate W.

Then, in the state in which the areas 131 to 135 are depressurized, at the substrate delivery position, the substrate W is delivered from the top ring 1 to the conveyance mechanism 600*b* (step S7).

As described above, in the present embodiment, in the conveyance before polishing, the suction range of the substrate W is narrowed. By virtue of this, the stress with respect to the substrate W can be reduced, and the polish rate in polishing can be stabilized.

Figure 9:
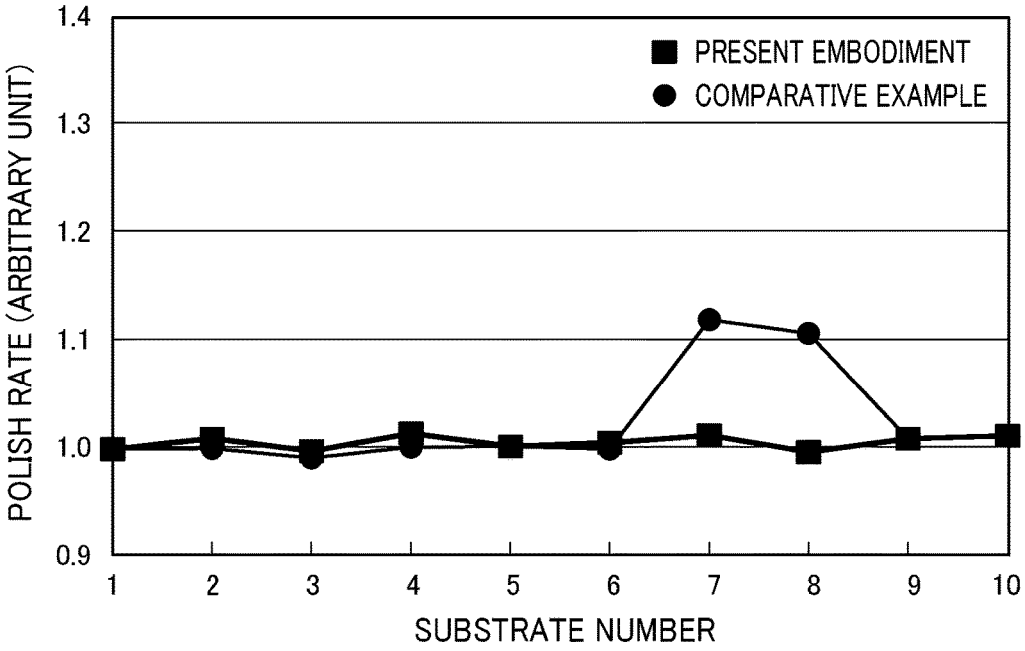
FIG. 9 is a graph showing the results of measuring polishing rates with varied suction ranges of substrates.

FIG. 9 is a graph showing the results of measuring polishing rates with varied suction ranges of substrates. Square marks represent the results of the case in which the suction range in the conveyance before polishing (step S2 of FIG. 5) is narrowed (only the area 134) as described in the present embodiment, and circular marks represent the results of the case in which the suction range in the conveyance before polishing is large (the areas 131 to 135) as a comparative example. Ten substrates are polished in each case to measure polish rates, and the substrates are shown by a horizontal axis. Meanwhile, a vertical axis shows the measurement results of the polish rates of the substrates below the area 133 (unit is arbitrary). In the comparative example of this diagram, as a result of expanding the suction range, the polish rates of some of the substrates are significantly higher than the other substrates, wherein the polish rates are not stabilized. On the other hand, in the present embodiment, as a result of narrowing the suction range, the polish rates of the substrates are stabilized.

Meanwhile, in the present embodiment, the suction range of the substrate W is expanded in lift-off. By virtue of this, the retention force of the top ring 1 is increased, the substrate W can be reliably lifted off, and shape-changes of the membrane 13 can be suppressed.

Figure 10:
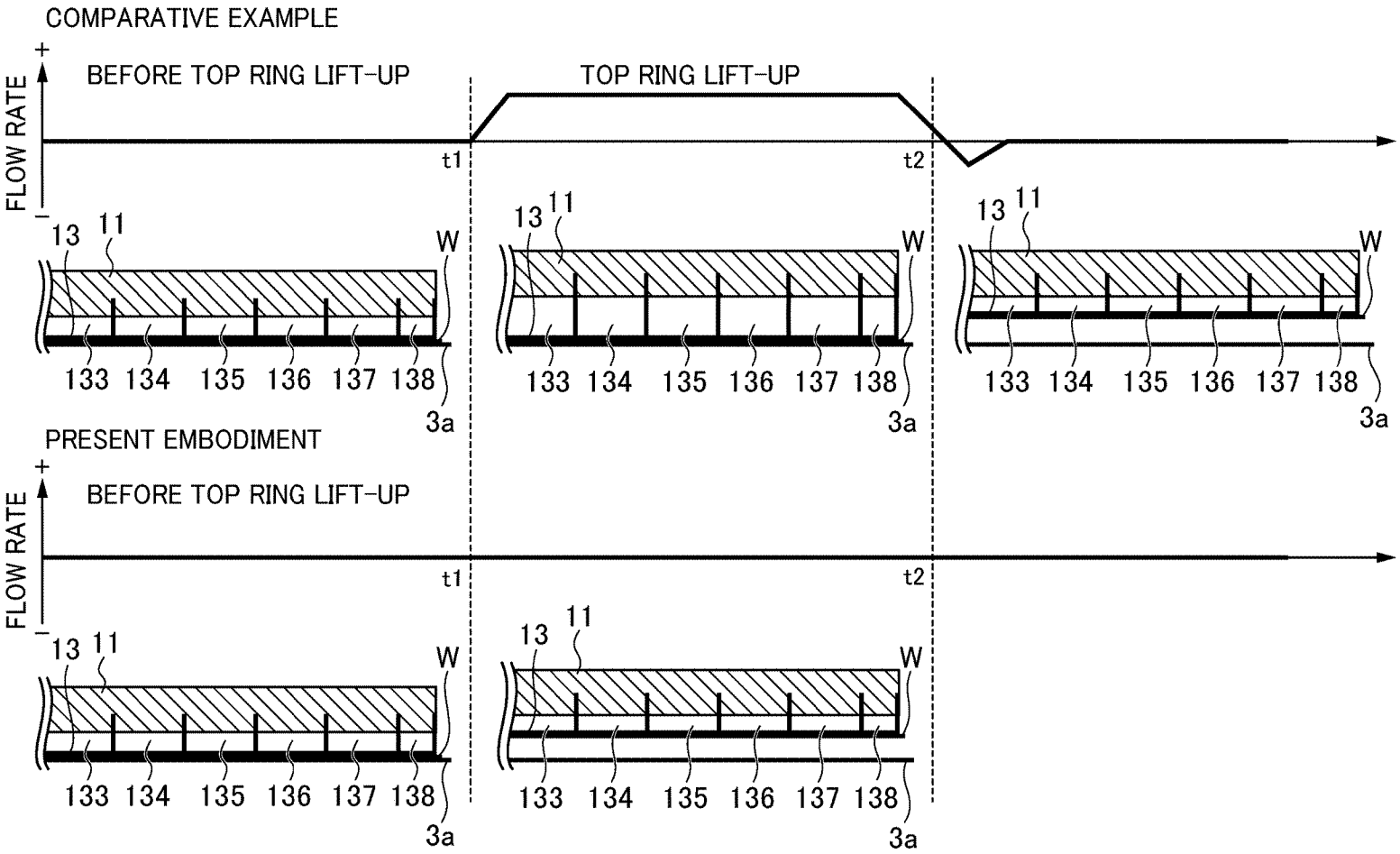
FIG. 10 is a diagram schematically showing the flow rates of the areas and the shape changes of a membrane in the case of lift-off with the varied suction ranges of a substrate.

FIG. 10 is a diagram schematically showing the flow rates of the areas and the shape changes of the membrane 13 in the case of lift-off with the varied suction ranges of the substrate W. The upper part of this diagram shows a comparative example of a case in which the suction range in lift-off is narrowed (only the area 134), and the lower part of this diagram shows the present embodiment of the case in which the suction range in lift-off is expanded (the areas 131 to 135).

In the comparative example, the area 134 is sucked, but the other areas 131 to 133 and 135 to 138 are not sucked, but are in a free state. At a time point when the top ring 1 starts lift-up at time t1, the substrate W is pulled by the polishing pad 3*a*, the membrane 13 is stretched, and the volumes of the areas 131 to 138 are increased. As a result, a gas flows into the areas 131 to 138, and the flow rate becomes positive.

Then, at time t2 when the top ring 1 is further lifted up, the substrate W is separated from the polishing pad 3*a* by the tensile force of the membrane 13, the membrane 13 returns to the original state, and the volumes of the areas 131 to 138 are reduced. Therefore, the flow rate temporarily becomes negative, and, then, the flow rate stably becomes 0.

In this manner, when the suction range in lift-off is narrow, the membrane 13 undergoes shape changes, and the flow rates of the areas 131 to 138 are not stable.

On the other hand, in the present embodiment, the areas 131 to 135 are sucked. Since the suction range is large at the time point when the top ring 1 starts lift-up at the time t1, the influence of the substrate W pulled by the polishing pad 3*a* is small, and the substrate W is immediately separated from the polishing pad 3*a*. Therefore, the membrane does not undergo shape changes almost at all, and the flow rates of the areas 131 to 138 are stabilized to 0.

In this manner, in the first embodiment, the suction range of the substrate W is narrowed in the conveyance before polishing, and the suction range of the substrate W in the conveyance after polishing is expanded. By virtue of this, the stress applied to the substrate W can be reduced, the polish rate is stabilized, and the lift-off can be reliably carried out. Therefore, the substrate can be appropriately handled from reception to lift-off of the substrate W, and defects such as substrate cracking and conveyance errors such as substrate fall/missing can be suppressed, and yield and productivity are improved.

Note that, in the present embodiment, only the area 134 is depressurized in the conveyance before polishing, and the areas 131 to 135 are depressurized in the conveyance after polishing. However, the present invention is not limited thereto, but only requires expanding the suction range in the conveyance after polishing than that in the conveyance before polishing. For example, in the conveyance before polishing, instead of the annular region, only a circular area may be depressurized to suck the substrate W. Specifically, in the conveyance before polishing, only the area 131 may be depressurized, the areas 131 and 132 may be depressurized, or the areas 131 to 133 may be depressurized. Then, in the conveyance after polishing, the region of a range larger than that in the conveyance before polishing, for example, the area depressurized in the conveyance before polishing and the inner and/or outer area(s) thereof may be depressurized.

(Second Embodiment)

The above described first embodiment expands the suction range in lift-off. However, depending on a case, expansion of the suction range may deform the substrate and apply stress to the substrate.

Figure 11:
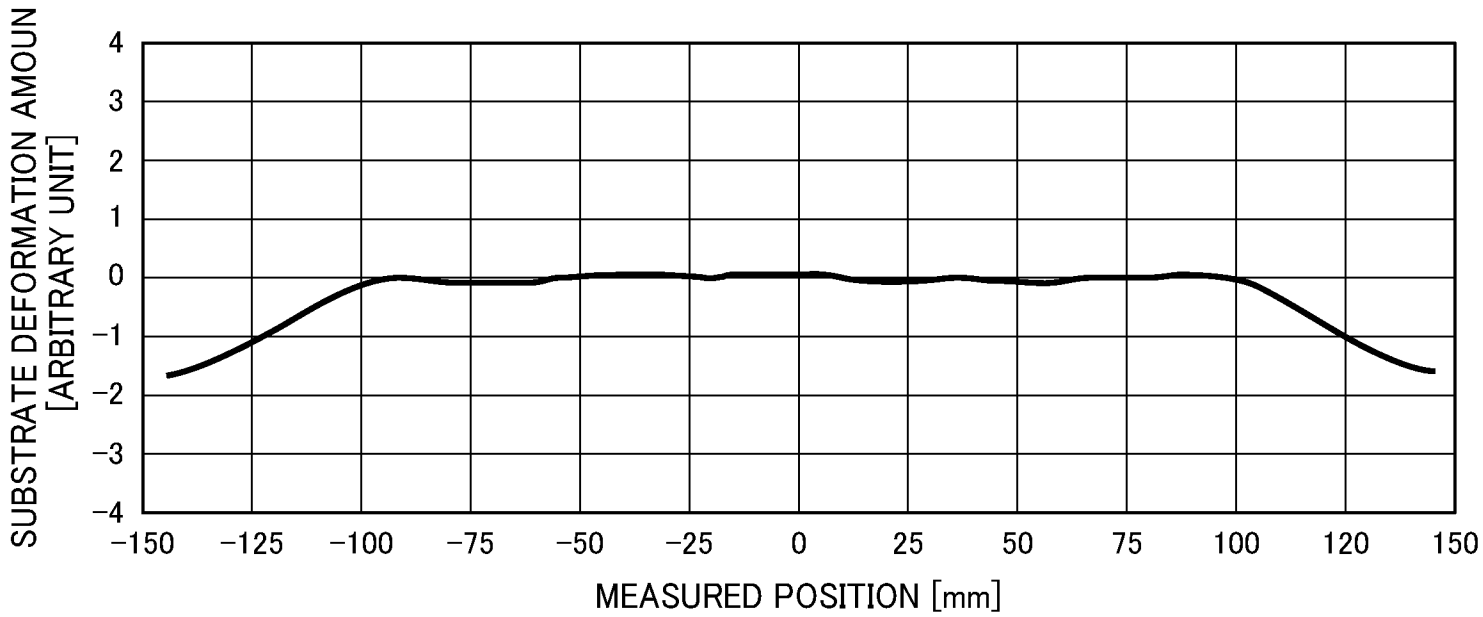
FIG. 11 is a graph of deformation amounts of a substrate in lift-off measured in a case in which the suction range is expanded.

FIG. 11 is a graph of deformation amounts of a substrate in lift-off measured in a case in which the suction range is expanded. In this diagram, the substrate of 300 mm was measured, a horizontal axis represents positions on the substrate, and a vertical axis represents deformation amounts (however, the side of the polishing pad 3*a*, in other words, a downward direction is positive). As shown in the diagram, outer peripheries of the substrate are largely deformed. Meanwhile, deformation occurs in the side which is outside the position of about 100 mm from the center of the substrate, and stress is applied to this position.

Therefore, in a second embodiment described below, a supporter is provided between the top-ring main body 11 and the membrane 13 to suppress the deformation of the membrane 13, thereby suppressing the deformation of the substrate.

Figure 12:
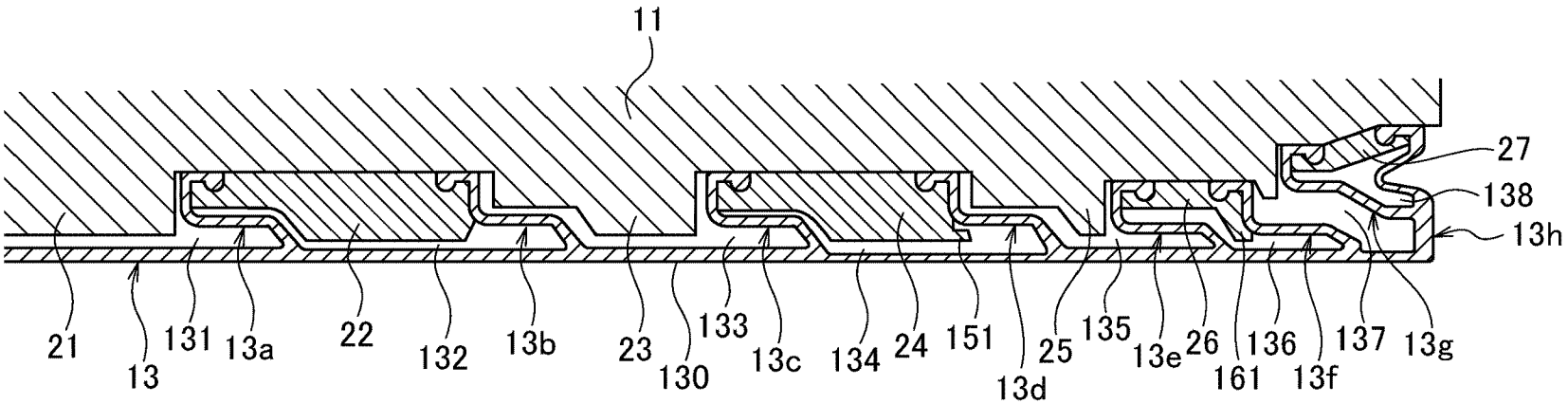
FIG. 12 is a cross-sectional view showing the membrane.

FIG. 12 is a cross-sectional view showing the membrane 13. The membrane 13 has a circular abutting portion 130, which contacts the substrate W, and the eight peripheral walls 13*a* to 13*h*, which are directly or indirectly connected to the abutting portion 130. The abutting portion 130 contacts and retains the back surface of the substrate W, in other words, the surface in the opposite side of the surface to be polished. Moreover, the abutting portion 130 presses the substrate W against the polishing pad 3*a* in polishing. The peripheral walls 13*a* to 13*h* are the annular peripheral walls which are concentrically disposed.

Upper ends of the peripheral walls 13*a* to 13*h* are sandwiched between retaining rings 22, 24, 26, and 27 and the lower surface of the top-ring main body 11 and are attached to the top-ring main body 11. These retaining rings 22, 24, 26, and 27 are detachably fixed to the top-ring main body 11 by retaining means (not shown). Therefore, when the retaining means is released, the retaining rings 22, 24, 26, and 27 are separated from the top-ring main body 11, and, as a result, the membrane 13 can be detached from the top-ring main body 11. As the retaining means, screws or the like can be used.

The peripheral wall 13*h* is the outermost peripheral wall, and the peripheral wall 13*g* is disposed in the radial-direction inner side of the peripheral wall 13*h*. Furthermore, the peripheral wall 13*f* is disposed in the radial-direction inner side of the peripheral wall 13*g*. Hereinafter, the peripheral wall 13*h* will be referred to as a first edge peripheral wall, the peripheral wall 13*g* will be referred to as a second edge peripheral wall, and the peripheral wall 13*f* will be referred to as a third edge peripheral wall.

Figure 13:
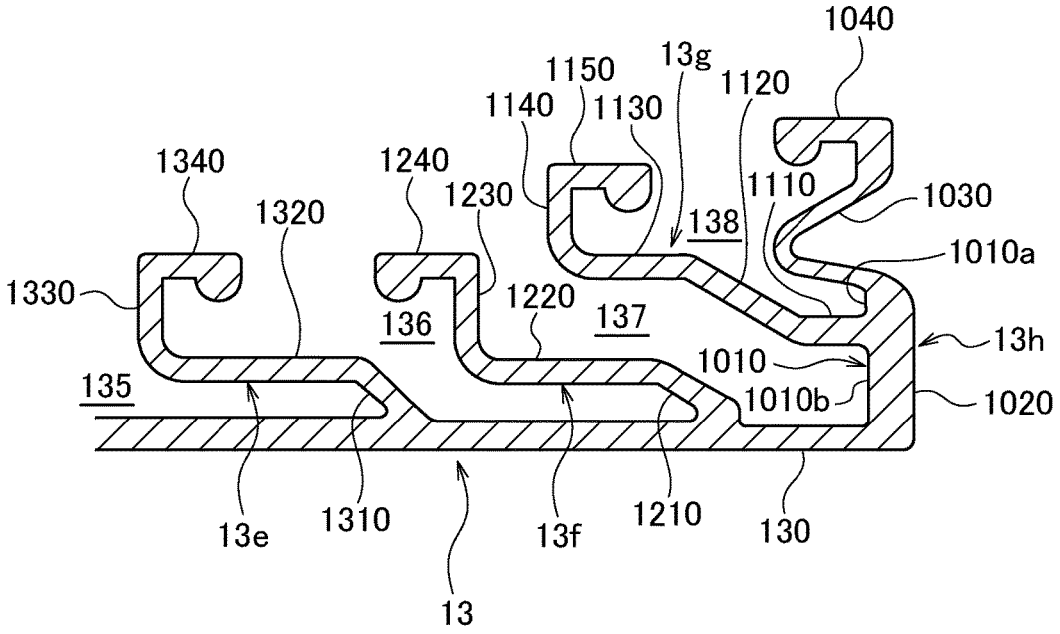
FIG. 13 is an enlarged cross-sectional view showing part of the membrane.

FIG. 13 is an enlarged cross-sectional view showing part of the membrane 13. In order to enable adjustment of the polish rate in the narrow range of an edge portion of the substrate W, the membrane 13 employs the shape as shown in FIG. 13. Hereinafter, the membrane 13 will be described in detail. The first edge peripheral wall 13*h* extends upward from a peripheral end portion of the abutting portion 130, and the second edge peripheral wall 13*g* is connected to the first edge peripheral wall 13*h*.

The second edge peripheral wall 13*g* has an outer horizontal portion 1110 connected to an inner peripheral surface 1010 of the first edge peripheral wall 13*h*. The inner peripheral surface 1010 of the first edge peripheral wall 13*h* has an upper inner peripheral surface 1010*a* and a lower inner peripheral surface 1010*b* perpendicularly extending with respect to the abutting portion 130. The upper inner peripheral surface 1010*a* is extending upward from the horizontal portion 1110 of the second edge peripheral wall 13*g*, and the lower inner peripheral surface 1010*b* is extending downward from the horizontal portion 1110 of the second edge peripheral wall 13*g*. In other words, the outer horizontal portion 1110 of the second edge peripheral wall 13*g* is connected to the position that divides the inner peripheral surface 1010, which is perpendicularly extending with respect to the abutting portion 130. The lower inner peripheral surface 1010*b* is connected to an end portion of the abutting portion 130. An outer peripheral surface 1020 positioned outside the lower inner peripheral surface 1010*b* is also perpendicularly extending with respect to the abutting portion 130. The upper inner peripheral surface 1010*a* and the lower inner peripheral surface 1010*b* are in the same plane. The "same plane" is an imaginary plane perpendicular to the abutting portion 130. In other words, the radial-direction position of the upper inner peripheral surface 1010*a* and the radial-direction position of the lower inner peripheral surface 1010*b* are the same.

The first edge peripheral wall 13*h* has a bent portion 1030 which allows upward/downward movement of the abutting portion 130. This bent portion 1030 is connected to the upper inner peripheral surface 1010*a*. The bent portion 1030 has a bellows structure configured to be stretchable/shrinkable in the direction perpendicular to the abutting portion 130 (in other words, vertical direction). Therefore, even if the distance between the top-ring main body 11 and the polishing pad 3*a* is changed, the contact between the peripheral end portion of the abutting portion 130 and the substrate W can be maintained. The first edge peripheral wall 13*h* has a rim portion 1040 extending from an upper end of the bent portion 1030 to the radial-direction inner side. The rim portion 1040 is fixed to the lower surface of the top-ring main body 11 by the retaining ring 27 shown in FIG. 12.

The second edge peripheral wall 13*g* has the outer horizontal portion 1110 horizontally extending from the inner peripheral surface 1010 of the first edge peripheral wall 13*h*. Furthermore, the second edge peripheral wall 13*g* has: a tilted portion 1120 connected to the outer horizontal portion 1110, an inner horizontal portion 1130 connected to the tilted portion 1120, a vertical portion 1140 connected to the inner horizontal portion 1130, and a rim portion 1150 connected to the vertical portion 1140. The tilted portion 1120 is extending from the outer horizontal portion 1110 to the radial-direction inner side and is tilted upward. The rim portion 1150 is extending from the vertical portion 1140 to the radial-direction outer side and is fixed to the lower surface of the top-ring main body 11 by the retaining ring 27 shown in FIG. 12. When the first edge peripheral wall 13*h* and the second edge peripheral wall 13*g* are attached to the lower surface of the top-ring main body 11 by the retaining ring 27, the area 138 is formed between the first edge peripheral wall 13*h* and the second edge peripheral wall 13*g*.

The third edge peripheral wall 13*f* is disposed in the radial-direction inner side of the second edge peripheral wall 13*g*. The third edge peripheral wall 13*f* has: a tilted portion 1210 connected to the upper surface of the abutting portion 130, a horizontal portion 1220 connected to the tilted portion 1210, a vertical portion 1230 connected to the horizontal portion 1220, and a rim portion 1240 connected to the vertical portion 1230. The tilted portion 1210 is extending from the upper surface of the abutting portion 130 to the radial-direction inner side and is tilted upward. The rim portion 1240 is extending from the vertical portion 1230 to the radial-direction inner side and is fixed to the lower surface of the top-ring main body 11 by the retaining ring 26 shown in FIG. 12. When the second edge peripheral wall 13*g* and the third edge peripheral wall 13*f* are attached to the lower surface of the top-ring main body 11 respectively by the retaining rings 27 and 26, the area 137 is formed between the second edge peripheral wall 13*g* and the third edge peripheral wall 13*f*.

The peripheral wall 13*e* is disposed in the radial-direction inner side of the third edge peripheral wall 13*f*. The peripheral wall 13*e* has: a tilted portion 1310 connected to the upper surface of the abutting portion 130, a horizontal portion 1320 connected to the tilted portion 1310, a vertical portion 1330 connected to the horizontal portion 1320, and a rim portion 1340 connected to the vertical portion 1330. The tilted portion 1310 is extending from the upper surface of the abutting portion 130 to the radial-direction inner side and is tilted upward. The rim portion 1340 is extending from the vertical portion 1330 to the radial-direction outer side and is fixed to the lower surface of the top-ring main body 11 by the retaining ring 26 shown in FIG. 12. When the peripheral wall 13*e* and the third edge peripheral wall 13*f* are attached to the lower surface of the top-ring main body 11 by the retaining ring 26, an area 136 is formed between the peripheral wall 13*e* and the third edge peripheral wall 13*f*.

The peripheral walls 13*b* and 13*d* shown in FIG. 12 practically have the same configurations as the third edge peripheral wall 13*f* shown in FIG. 12, and the peripheral walls 13*a* and 13*c* shown in FIG. 12 practically have the same configurations as the peripheral wall 13*e* shown in FIG. 12. Therefore, the description thereof will be omitted. As shown in FIG. 12, rim portions of the peripheral walls 13*a* and 13*b* are fixed to the lower surface of the top-ring main body 11 by the retaining ring 22, and rim portions of the peripheral walls 13*c* and 13*d* are fixed to the lower surface of the top-ring main body 11 by the retaining ring 24. Note that, in the areas 131, 133, and 135, rings 21, 23, and 25 projecting from the top-ring main body 11 are formed, respectively.

The area 136 formed below the retaining ring 26 is narrower than each of the areas 132 and 134 formed respectively below the retaining rings 22 and 24 and the areas 131, 133, and 135 below the rings 21, 23, and 25.

The top ring 1 in the present embodiment has a supporter 161, which is in the area 136 and extending toward the membrane 13. Specifically, the supporter 161 is extending downward through the part between the peripheral wall 13*e* and the peripheral wall 13*f* of the membrane 13. More specifically, the supporter 161 is tilted approximately in parallel with the tilted portion 1310 (FIG. 13) of the peripheral wall 13*e*, but is not extending to the lower side of the horizontal portion 1220 of the peripheral wall 13*f*. Moreover, the lower surface of the supporter 161 is approximately parallel to the membrane 13. The supporter 161 is a member which is integrated with the retaining ring 26 and may be a ring-shaped concentric projection extending from the retaining ring 26.

Also, the top ring 1 may have a supporter 151, which is in the area 134 and extending approximately in parallel with the membrane 13. The supporter 151 is a member integrated with the retaining ring 24 and may be a ring-shaped concentric projection extending from the retaining ring 24.

In this manner, the lower surface of the retaining ring 22, the lower surfaces of the retaining ring 24 and the supporter 151, and the lower surface of the supporter 161 (furthermore, the lower surfaces of the respective rings 21, 23, and 25 integrated with the top-ring main body 11 of the areas 131, 133, and 135) are desired to be on the same plane as much as possible.

The projection shapes of the supporters 161 and 151 do not disturb stretching of the membrane 13 in the vertical direction and the radial direction; however, when the areas are depressurized to retain the substrate, shape changes of the membrane 13 in the vertical direction are suppressed. By virtue of this, even in a case in which the substrate is sucked by a large region (for example, the above described areas 131 to 135) in the conveyance after polishing, deformation of the substrate is suppressed as much as possible, the substrate can be flatly and uniformly retained, and the stress with respect to the substrate can be suppressed.

When the substrate is to be sucked by the membrane 13, the area 136 corresponds to the part that abuts an edge of the substrate (within about 20 mm from the peripheral edge of the substrate). The area 136 is narrower than the inner areas 131 to 135. Normally, for improving the edge controllability of polishing profile, the idea of providing the supporter in the area 136 in this manner is not readily thinkable. However, in the present embodiment, deformation of the substrate can be suppressed by venturously providing the supporter in the area 136 corresponding to the edge of the substrate.

Figure 14:
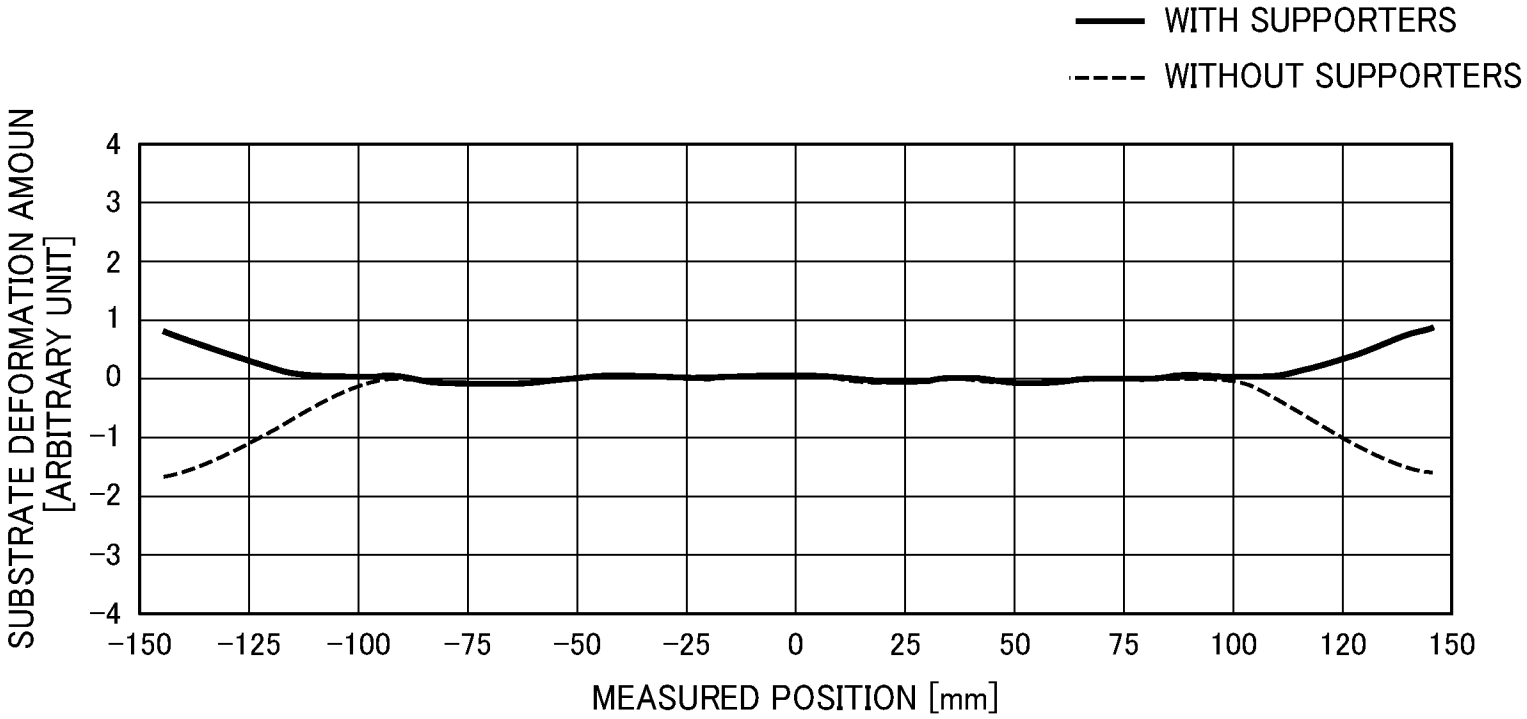
FIG. 14 is a graph of deformation amounts of substrates measured in lift-off with/without supporters.

FIG. 14 is a graph of deformation amounts of substrates measured in lift-off with/without the supporters. A solid line in this diagram shows the case with the supporters. A broken line in this diagram shows the case without the supporters and is similar to FIG. 11. As shown in the diagram, if the supporters are not provided, the outer periphery portions of the substrate are largely deformed; however, if the supporters are provided, the shape changes of the substrate W can be suppressed to less than half.

In this manner, in the second embodiment, the supporters are provided within the areas. Therefore, even in the case in which the substrate is sucked by a large range, shape changes of the membrane 13 are suppressed, and the stress with respect to the substrate can be reduced.

The above described embodiments are described with the intention that those who have normal knowledge in the technical field to which the present invention pertains can carry out the present invention. Various modification examples of the above described embodiments can be carried out by those skilled in the art as a matter of course, and the technical ideas of the present invention can be applied also to other embodiments. Therefore, the present invention is not limited to the described embodiments, but should have a largest scope in accordance with the technical ideas defined by claims.

What is claimed is:

1. A substrate polishing method comprising:

conveying a substrate to a position above a polishing pad by suctioning the substrate by a first region of an elastic film, wherein regions other than the first region are not suctioned;

polishing the substrate while bringing the substrate into contact with the polishing pad; and lifting off the substrate by suctioning the substrate by a second region of the elastic film, the second region being larger than the first region.

2. A substrate polishing method comprising:

conveying a substrate to a position above a polishing pad by depressurizing a first area among pressure adjustable areas between a top-ring main body and an elastic film to suction the substrate by a lower surface of the elastic film, wherein no suction is applied to areas other than the first area;

polishing the substrate while bringing the substrate into contact with the polishing pad; and lifting off the substrate by depressurizing a second area among the pressure adjustable areas to suction the substrate by the lower surface of the elastic film, the second area being larger than the first area.

3. The substrate polishing method according to claim 2, wherein the plurality of pressure adjustable areas are formed between the top-ring main body and the elastic film, the first area comprises a first number of areas among the plurality of areas, and the second area comprises a second number of areas among the plurality of areas, the second number being larger than the first number.

4. The substrate polishing method according to claim 3, wherein the second area is concentrically larger than the first area.

5. The substrate polishing method according to claim 3, wherein the first area is a circular or annular area.

6. The substrate polishing method according to claim 2, wherein upon polishing the substrate, at least part of the pressure adjustable areas is pressurized.

7. The substrate polishing method according to claim 2, wherein a supporter extending toward the elastic film is provided in the pressure adjustable area.

8. A substrate polishing apparatus comprising:

a top ring;

a polishing table having a polishing pad configured to contact the substrate retained by the top ring to polish the substrate; and a pressure controller configured to control a pressure of the pressure adjustable areas, wherein the top ring comprises:

the top-ring main body;

an elastic film below the top-ring main body and configured to form one or a plurality of pressure adjustable areas between the top-ring main body and the elastic film; and a supporter in the area extending toward the elastic film, and wherein the pressure controller is configured to depressurize a first area among the pressure adjustable areas when the substrate is conveyed before the substrate is polished, wherein areas other than the first area are not depressurized, and depressurize a second area among the pressure adjustable areas when the substrate is lifted off from the polishing pad after the substrate is polished, second area being larger than the first area.

* * * * *